United States Patent [19]

Pylant

[11] 3,973,486

[45] Aug. 10, 1976

[54] PRINTER

[75] Inventor: John D. Pylant, Santa Ana, Calif.

[73] Assignee: Hycom Incorporated, Irvine, Calif.

[22] Filed: Dec. 5, 1974

[21] Appl. No.: 529,745

[52] U.S. Cl. ..... 101/93.19; 101/93.07; 101/245; 197/18

[51] Int. Cl.[2] ..... B41J 1/22

[58] Field of Search ..... 101/235, 245, 93.07, 101/93.18, 93.19, 109, 110, 111; 197/18, 49, 1 R

[56] References Cited

UNITED STATES PATENTS

| | | | |
|---|---|---|---|
| 2,016,365 | 11/1952 | Hicks et al. | 101/93.07 |
| 2,825,559 | 3/1958 | Davidson | 101/93.19 |
| 3,037,447 | 6/1962 | Gonzalez et al. | 101/235 X |
| 3,633,497 | 1/1972 | Hartley | 101/93.18 X |
| 3,756,147 | 9/1973 | Gross et al. | 101/110 X |
| 3,795,190 | 3/1974 | Wallace | 101/233 |
| 3,805,696 | 4/1974 | Tsuji | 101/110 |

*Primary Examiner*—Edgar S. Burr
*Assistant Examiner*—Edward M. Coven
*Attorney, Agent, or Firm*—Gordon L. Peterson

[57] ABSTRACT

A printer comprising a supporting structure and a print disc having a curved peripheral surface with characters formed thereon. The print disc is mounted on the supporting structure for rotation about a rotational axis. Paper is moved over the peripheral surface in a direction generally parallel to the rotational axis, and one or more hammers cooperate with the paper and the characters for effecting printing on the paper. A guide generally conforms the paper to at least a portion of the curved peripheral surface as the paper is moved over the peripheral surface. This permits an entire line of characters to be printed and provides the paper with some rigidity against bending and an ability to extend generally vertically to permit the user to visually observe what has been printed. To eliminate noise during standby, the print disc is rotated through only one revolution in response to each print command.

18 Claims, 6 Drawing Figures

3
89
57
88
73
67
13
19
91
9
15
131
51
55
8
61
7
6
5
4
21
25
19
26
93
39
65
23
103
101
11
105
109
107
141
87
28
119
111
113
115
117
3

PRINTER

BACKGROUND OF THE INVENTION

This invention relates to a printer of the type useable in various environments, such as in calculators. Printers of this type typically utilize a drum, chain, or disc as the print member, i.e., the member which carries the characters to be printed. The print disc has the advantages of being smaller than either the drum or chain and has less inertia.

Paper or other medium on which printing is to occur is moved over the characters. Hammers are selectively actuated to impact the paper and ribbon between the hammers and the characters on the print member. This prints the selected characters on the paper.

During the course of a working day, a printer is called upon to print only intermittently. In some prior art impact printers, the print member rotates continuously during standby periods. In other prior art devices, special shut-off mechanisms are provided to shut off the print member a limited time after the most recent usage of the printer. In either event, rotation of the print member during standby occurs and, to this extent, the printer is worn unnecessarily and power is unnecessarily consumed. Most significant, however, is the annoyance to personnel caused by the noise of the motor and the noise inherent in rotating the print member during standby periods.

SUMMARY OF THE INVENTION

The present invention provides a printer which is automatically totally shut down during standby. In other words, no parts of the printer are moving during standby. This eliminates noise, wear and power consumption during standby.

These advantageous results can be accomplished by rotating the print member through a predetermined number of degrees in response to each command for printing. For example, the print member may be rotated through one revolution in response to each command for printing. The hammers cooperate with the characters while the print member rotates to effect printing of a line of information on the paper. The print member may be arranged to automatically come to rest upon the completion of only a single revolution.

The drive means for the print member can advantageously include energy storage means and a transmission for coupling the energy storage means to the print member. Releasable locking means holds the print member against rotation and upon the release of the locking means, the energy storage means drives the print member via the transmission. After a predetermined number of degrees to rotation, such as one revolution, the print member is automatically stopped.

The energy storage means may take the form of a spring. The spring can be simply and inexpensively cocked, i.e., provided with energy, by a solenoid. In response to each print command, the energy from the spring is transmitted to the print member and thereafter the solenoid automatically recocks the spring. The transmission preferably includes a one-way clutch which free wheels in one direction to prevent the cocking motion from being transmitted to the print member.

The concepts of this invention are applicable to various different kinds of print members. However, a print disc has the advantages of small size and low inertia as noted above. The low inertia property of a print disc makes it particularly applicable for use with the cocking and releasing drive mechanism described above because such a mechanism repeatedly starts and stops the print disc.

Another feature of the invention is that it reduces or eliminates any tendency of the ink from the ribbon to smear the paper. This can be accomplished by interposing a guide between the ribbon and the paper. The guide has a slot and the hammers act through the slot to cause the desired printing impact between the paper and the ribbon.

The print member has a curved peripheral surface, and the guide may also be used to cause the paper to generally conform to the curvature of the peripheral surface of the print member. The paper can be moved in a direction generally parallel to the rotational axis of the print member. By curving the paper and moving it as described above, it is possible, using a print disc, to print an entire line of characters on the paper with the line being transverse to the direction of paper movement.

Curving the paper provides it with rigidity against bending and an ability to project generally vertically above the print member for a limited distance without being mechanically supported in those regions. This materially enhances the visibility of the information printed on the medium without the cost of providing mechanical supporting means for the medium. To further enhance the visibility of the material printed on the paper, the paper above the peripheral surface may be inclined.

The invention can best be understood by reference to the following description taken in connection with the accompanying illustrative drawing.

DESCRIPTION OF THE PREFERRED EMBODIMENT

Figure 1:
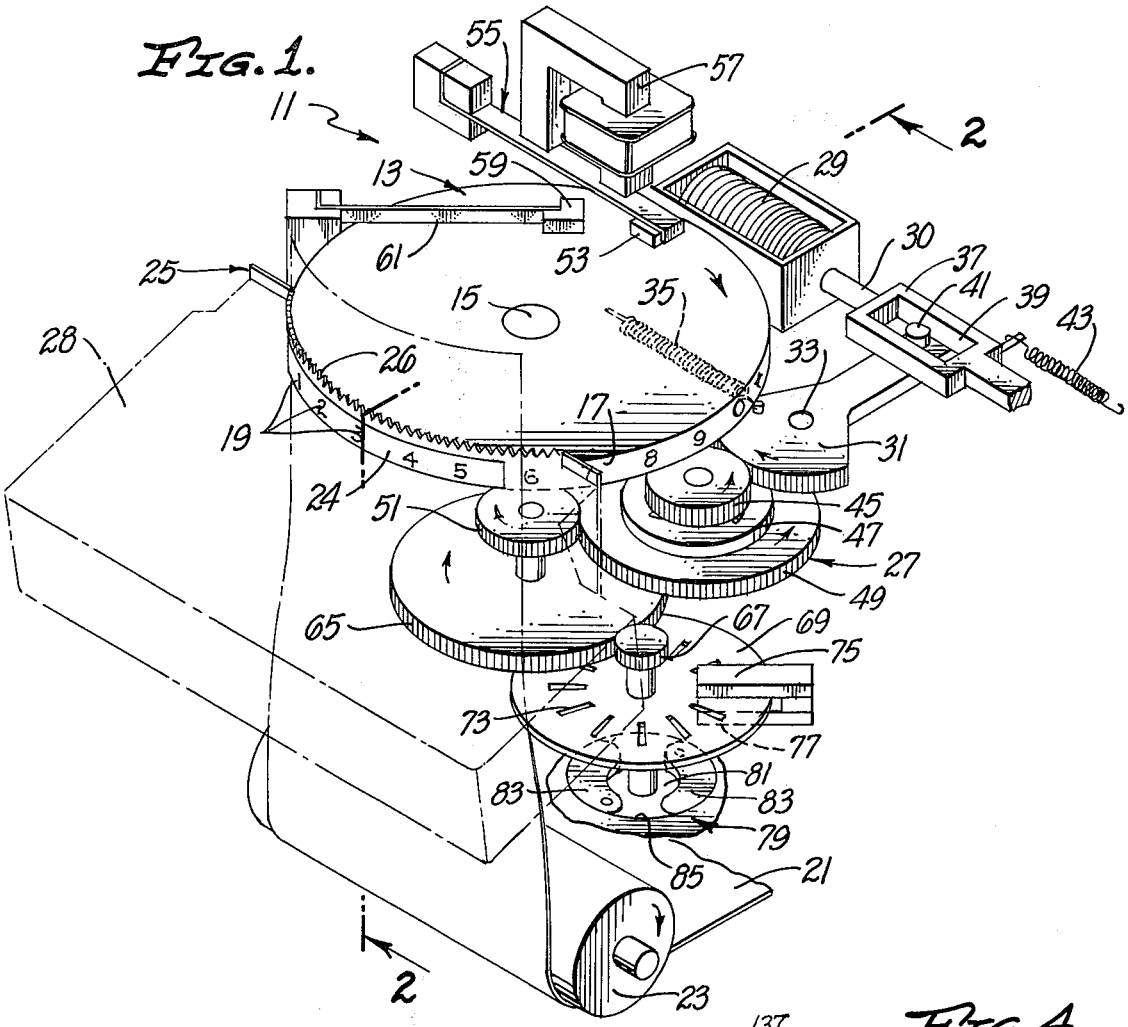
FIG. 1 is an isometric schematic view of a printer constructed in accordance with the teachings of this invention with the spring being shown in the cocked position.

FIG. 1 is a schematic showing of an impact printer 11 which includes a print member in the form of a print disc 13 mounted for rotation about a rotational axis by a shaft 15. The print disc 13 is an axially short cylinder, and it has a cylindrical peripheral surface 17. A plurality of characters 19 are embossed or otherwise provided on the peripheral surface 17.

A medium, such as an elongated flexible strip of paper 21, on which printing is to occur is moved over the peripheral surface 17 by suitable conventional means which may include a drive roller 23. A guide 25 causes the region of the paper 21 adjacent the peripheral surface 17 to generally conform to the curvature of the peripheral surface. Thus, the portion of the paper 21 which extends above the peripheral surface 17 is curved in a direction circumferentially of the rotational axis of the print disc 13, and the axis of the curved portion of the paper 21 extends generally parallel to the direction of movement of the paper over the peripheral surface.

The curvature of the portion of the paper 21 above the peripheral surfaces 17 gives this portion of the paper some rigidity against bending. In other words, a length of the paper 21 above the print disc 13 will stand up without the assistance of mechanical supporting means.

As the paper 21 passes over the peripheral surface 17, printing occurs on the convex surface of the paper in a manner described hereinbelow with reference to FIGS. 2–6. Accordingly, the printing on the convex surface of the paper 21 is readily visible to the user of the printer 11.

The guide 25 has a slot 24 through which hammers (not shown in FIG. 1) can cooperate wit the characters 19 to produce printing on the paper 21. The guide 25 also has an upper serrated edge 26 which serves as a tear bar to facilitate tearing of the paper 21. A ribbon magazine 28 for ribbon (not shown in FIG. 1) is shown in phantom lines in FIG. 1 and is described in greater particularity with reference to FIGS. 2–5.

The print disc 13 is rotated by a drive mechanism 27. The drive mechanism 27 stores energy and releases this energy to impart angular movement to the print disc 13.

The drive mechanism 27 includes a solenoid 29, a plunger 30, and a sector gear 31 mounted for pivotal movement about a shaft 33. The sector gear 31 is biased in a clockwise direction by energy storage means in the form of a spring 35. Although other power sources could be utilized, the solenoid has the advantage of being inexpensive, compact, and capable of rapidly cocking the spring 35.

Drive means 37 which may be of various different constructions drivingly couples the plunger 30 to the sector gear 31. The drive means 30 has a slot 39 cooperating with a pin 41 on the sector gear 31 to drivingly couple the plunger 30 of the solenoid 29 to the sector gear. Energization of the solenoid 29 pulls the drive means 37 to the left as viewed in FIG. 1 to thereby pivot the sector gear 31 counterclockwise to extend, and therefore cock the spring 35. The solenoid 29 is only momentarily energized to cock the spring 35, and immediately thereafter a solenoid return spring 43 returns the drive means 37 to the right as viewed in FIG. 1 to the de-energized position. Because of the slot 39, such movement of the drive means 37 to the de-energized position can be carried out without pivoting the sector gear 31.

The spring 35 in the embodiment illustrated is a coil extension spring. However, various other forms of energy storage devices including torsion springs, clock mainsprings, constant force springs, and many other kinds of springs can be employed.

The sector gear 31 drives a pinion 45 which in turn drives a one-way clutch 47, the latter being coupled to a gear 49. The one-way clutch 47 may be of any type which drives in one direction and free wheels in the opposite direction. For example, the one-way clutch 47 may be of the Sprag, roller, or ratchet type. The one-way clutch 47 is arranged to free wheel when the sector gear 31 is being pivoted by the solenoid 29 to cock the spring 35 and to drive in the opposite direction. Thus, the cocking motion of the sector gear 31 is not transmitted beyond the one-way clutch 47 in the drive mechanism 27. The one-way clutch 47 can be located at different places in the drive mechanism 27, so long as it is far enough toward the print disc 13 to isolate it from the cocking motion of the sector gear 31.

The gear 49 drives a print disc pinion 51 which is mounted on the shaft 15. Thus the spring 35 can drive the print disc 13 by way of the pinion 45, the one-way clutch 47, the gear 49, the print disc pinion 51, and the shaft 15. The drive mechanism 27 can, of course, be changed to alter various characteristics of the drive mechanism such as drive ratio.

The print disc 15 is normally held against such rotation by releasable locking means. Although the releasable locking means can take many different forms, in the embodiment illustrated, it includes a stop 53 carried by the print disc 13 and a main pawl 55 suitably fixedly mounted to an appropriate member other than the print disc. The main pawl 55 is constructed of resilient magnetic material and is normally self-biased downwardly into locking engagement with the stop 53 to prevent clockwise rotation of the print disc 13.

Means are provided for releasing the main pawl 55 from the stop 53 to thereby allow the spring 35 to drive the print disc 13 in the clockwise direction. Although the releasing means can take many different forms, in the embodiment illustrated, it includes electromagnetic means 57. When the electromagnetic means 57 is energized it pulls the main pawl 55 upwardly sufficiently so that it clears the stop 53. This releases the print disc 13 for rotation, the nergy for which is provided by the cocked spring 35. Energization of the electromagnetic means occurs in response to a print command, i.e., a command for printing. The print command can be provided in a manner known in the art.

Means are provided for stopping the rotation of the print disc after it has rotated through a predetermined number of degrees. In the embodiment illustrated, the print disc is allowed to rotate through one revolution in response to each print command. Although the stopping means can take different forms, in the embodiment illustrated, it includes the main pawl 55 and the stop 53. In order to utilize the stop 53 and the main pawl 55 for this purpose, the electromagnetic means 57 is energized only momentarily in response to each print command. Accordingly, immediately following release of the print disc 13 for rotation, the main pawl 55 returns under the influence of its own resiliency to a position in which it is engageable with the stop 53 upon completion of one revolution of the print disc 13.

As indicated hereinabove, the one-way clutch 47 free wheels to prevent rotation of the print disc 13 in response to the cocking motion of the sector gear 31. However, the drag of the one-way clutch 47 in its slipping motion applies a small reverse torque to the print disc 13. Means are provided for positively preventing counter-rotation of the print disc 13. In the embodiment illustrated, such means includes a stop 59 carried by the disc and an anti-backup pawl 61 fixedly mounted on structure other than the print disc. The end of the anti-backup pawl 61 seats against the stop 59 to prevent counter-rotation of the print disc 13. The pawl 61 is resilient and can be forced out of the way by the stop 59 to thereby allow the stop 59 to move past the pawl 61.

Printing occurs with the print disc 13 on the "fly" and one line of print is provided for each revolution of the print disc. Such line of print is transverse to the direction of movement of the paper 21 over the peripheral surface 17. In order for the proper character to be printed in the appropriate column on the paper 21, it is essential that the location of the characters 17 on the print disc 13 be known as the print disc rotates. This function can, of course, be obtained in various ways.

For example, the printer 11 includes a print disc gear 65 mounted on and rotatable with the shaft 15 and a timing pinion 67 driven by the gear 65. The timing pinion 67 and a timing disc 69 are mounted on a common shaft 71. The timing disc 69 has a plurality of slots 73 arranged in circumferentially spaced relationship. A light emiting diode 75 and a photocell 77 are suitably fixedly mounted above and below the timing disc 69, respectively. As the timing disc 69 rotates, light passes from the diode 75 to the photocell 77 each time one of the slots 73 comes into registry with these two elements. The gear ratios and the timing disc slots are arranged so that one slot 73 uncovers the diode 75 each time one of the characters 19 on the peripheral surface 17 passes a reference location. This enables the photocell 77 to produce a timing pulse each time a character passes the reference location. These timing pulses can be utilized in a conventional manner, such as in chain printers, to cause printing of the selected character in the appropriate column.

A governor 79 tends to regulate the maximum angular velocity of the shaft 71 and hence of the print disc 13. In the embodiment illustrated, the governor 79 includes a plate 81 mounted on and driven by the shaft 71, a pair of fly weights 83 pivotally mounted on the plate 81 at a location spaced from its rotational axis, and a fixed drum surface 85 against which the outer peripheries of the fly weights 83 can slide. Thus, the force of friction between the drum surface 85 and the fly weights 83 increases as the angular velocity of the shaft 71 increases.

Figure 2:
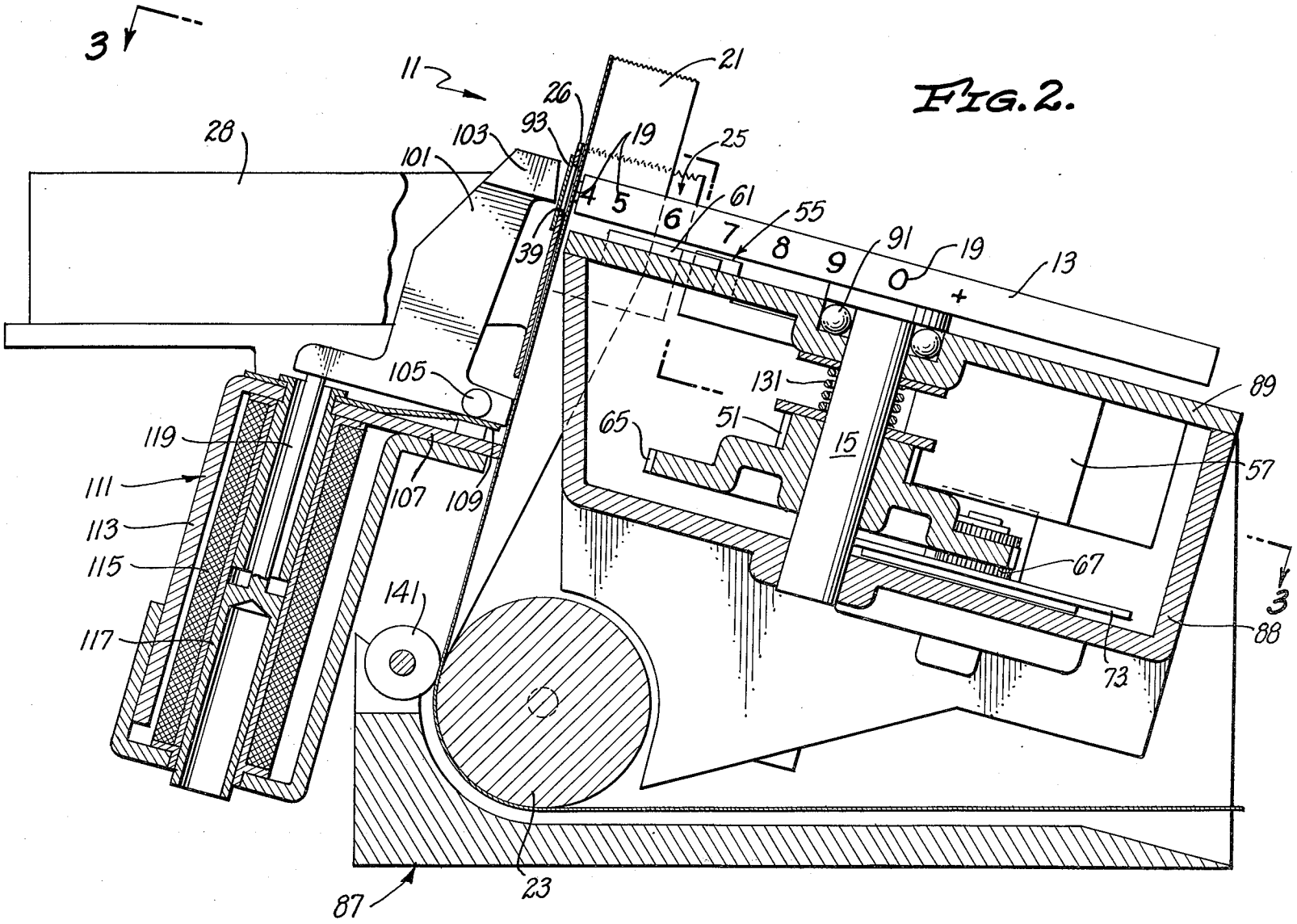
FIG. 2 is an enlarged fragmentary sectional view which for reference purposes may be considered as having been taken generally along line 2—2 of FIG. 1.

FIGS. 2–6 show in greater detail one way in which the printer 11 can be constructed. With reference to FIG. 2, the printer 11 includes a supporting structure 87 which in turn includes a housing 88 for the printer. The housing 88 includes a removable cover 89, and the print disc 13 is mounted above the cover by the shaft 15 and by a bearing 91. The lower end of the shaft 15 is received in the bottom wall of the housing 88. The plane of the print disc 13 is inclined relative to the horizontal and to the vertical. Although the angle of incline could vary, in the embodiment illustrated the print disc 13 is inclined approximately 15° relative to a horizontal plane.

The ribbon magazine 28 is suitably mounted on the supporting structure 87. The ribbon magazine 28 is adapted to contain a length of ribbon 93 (FIGS. 2 and 3) of the type suitable for use with an impact printer. A drive roller 95 (FIG. 3) and a pressure roller 97 are rotatably mounted within the ribbon magazine 28 with the latter being mounted in a housing 98 which is urged by a spring 99 toward the drive roller. Thus, rotation of the drive roller 95 pulls the ribbon 93 in the direction of the arrow in FIG. 3. The opposite ends of the ribbon 93 are loose within the ribbon magazine. The movement of the ribbon is guided by the guide 25 with the ribbon being on the side of the guide opposite the paper 21 as shown in FIG. 2. The guide 25 is carried by the ribbon magazine 28. The guide 25 separates the ribbon 93 and the paper 21 sufficiently to prevent ink from the ribbon smearing the paper.

The printer 11 includes a plurality of hammers 101 (FIGS. 2 and 3), each of which has a head 103. Printing on the paper 21 is accomplished by the head 103 of the appropriate hammer 101 striking the ribbon 93 to force the latter against the paper 21 and to force the paper 21 against an appropriate character 19. The head 103 of each of the hammers 101 is sized and oriented so as to be receivable in the slot 39 of the guide 25.

Each of the hammers 101 is a character spanning hammer. In other words, the head 103 of each of the hammers 101 has a sufficient circumferential dimension to span two or more columns. In the embodiment illustrated, each of the heads 103 spans three columns. This enables a single one of the hammers 101 to print a character in any one of three adjacent columns. Of course, the characters 19 are spaced circumferentially on the print disc 13 so that only one of the characters 19 confronts a hammer 101 at any angular position of the print disc 13.

The hammers 101 can be mounted for movement in many different ways so as to permit impact printing on the paper 21. In the embodiment illustrated, each of the hammers 101 is pivotally mounted by a pin 105 which is carried by a plate 107 which forms a portion of the supporting structure 87. Each of the pins 105 mounts the associated hammer for pivotal movement about a generally horizontal pivot axis. A leaf spring 109 carried by the plate 107 biases the associated hammer 101 in the counter-clockwise direction about the pin 105 toward a retracted position as illustrated in FIG. 2.

Figure 3:
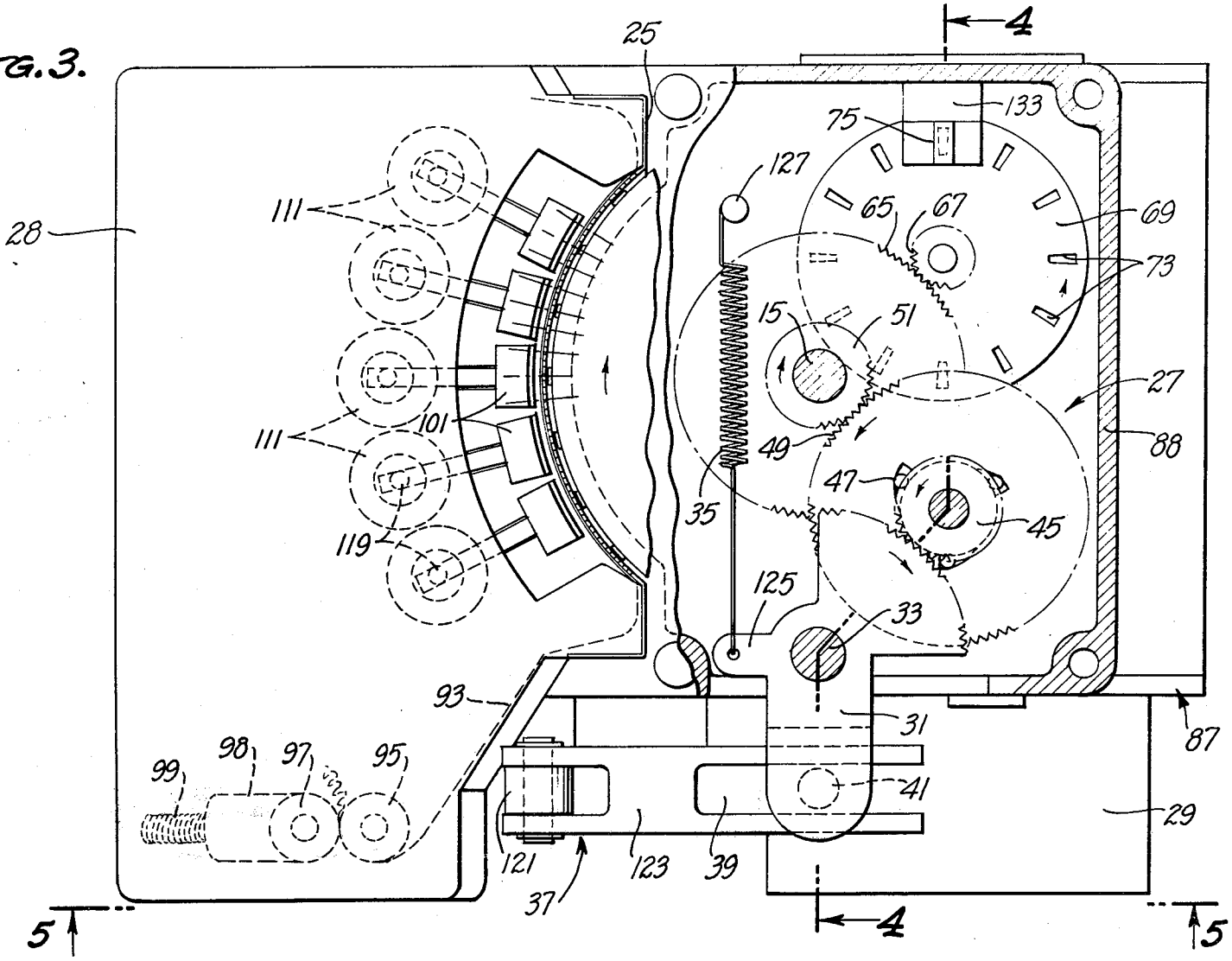
FIG. 3 is a sectional view taken generally along line 3—3 of FIG. 2 with the spring being in the cocked position and with parts broken away.

Each of the hammers 101 can be individually pivoted about its pin 105 by a solenoid 111 (FIGS. 2 and 3). As shown in FIG. 2, each of the solenoids 111 includes a housing 113, a coil 115, and an axially movable armature 117 which terminates upwardly in a hammer actuator 119. When one of the solenoids 111 is energized, the armature 117 thereof is drawn upwardly further into the field of the coil 115 thereby moving the hammer actuator 119 upwardly to pivot the associated hammer 101 clockwise about its pin 105 to print a character on the paper 21.

Figure 4:
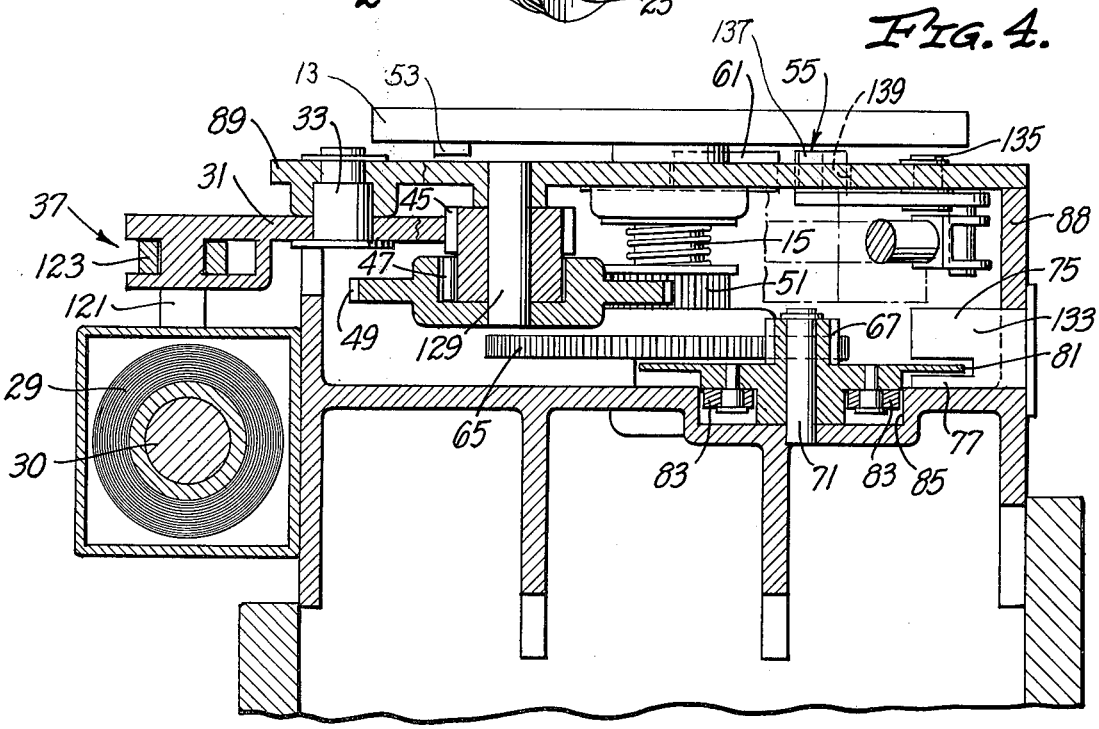
FIG. 4 is a sectional view taken generally along line 4—4 of FIG. 3.
Figure 5:
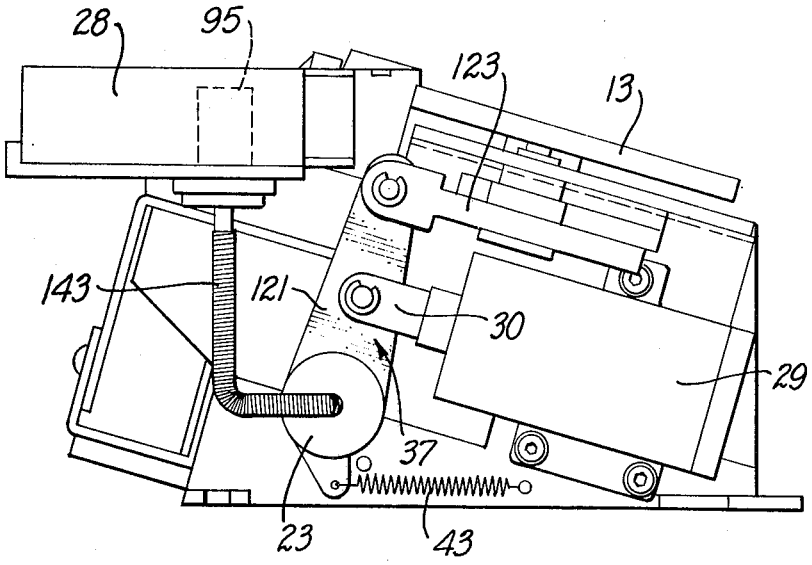
FIG. 5 is a side elevational view taken generally along line 5—5 of FIG. 3.

Considering now the drive mechanism 27, the solenoid 29 is mounted on the exterior of the supporting structure 87 as shown in FIGS. 3–5. The drive means 37 includes an arm 121 (FIG. 5) pivotally mounted on the supporting structure 87 and coupled to the plunger 30 of the solenoid 29. The solenoid return spring 43 biases the arm 121 in the counterclockwise direction as viewed in FIG. 5. The drive means 37 also includes a yoke 123 which is pivotally coupled to the upper end of the arm 121. The yoke 123 has the slot 39 therein which slidably receives the pin 41 carried by one end of the sector gear 31. The sector gear 31 is mounted by the shaft 33 to the cover 89 as shown in FIG. 4. The spring 35 is coupled at one end to a lug 125 (FIG. 3) on the sector gear 31 and at the other end to a post 127 of the supporting structure 89.

The pinion 45, the one-way clutch 47, and the gear 49 are mounted on a common shaft 129 which is attached to the cover 89 as shown in FIG. 4. The print disc pinion 51 and the gear 65, in the embodiment illustrated, are formed integrally and suitably affixed to the shaft 15 as shown in FIGS. 2 and 4. A spring 131 acts between the print disc pinion 51 and the cover 89 to preload the bearing 91. The timing pinion 67 and the plate 81 are formed integrally and mounted on the shaft 71 which in turn is mounted on the bottom wall of the housing 88 as shown in FIG. 4. The fly weights 83 are pivotally mounted on and beneath the plate 81, and a peripheral surface of a well integrally formed in the bottom wall of the housing 88 defines the drum surface 85. The diode 75 and the photocell 77 are mounted in a housing 133 which is attached to the peripheral wall of the housing 88 as shown in FIGS. 3 and 4.

Figure 6:
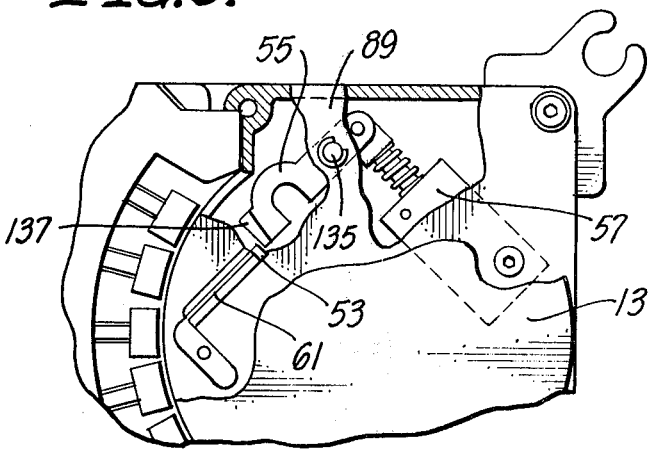
FIG. 6 is a fragmentary plan view with portions of the print disc and housing cover broken away.

The stop 53 is carried on the lower face of the print disc 13 (FIGS. 4 and 6). In FIG. 4 the print disc 13 is rotated to show the stop 53. The main pawl 55 is pivotally mounted by a pin 135 on the cover 89 immediately below the print disc 13. The main pawl 55 has an upwardly projecting flange 137 which extends upwardly through a slot 139 (FIG. 4) in the cover 89 so that the flange can contact the stop 53. The electromagnetic means 57 may take the form of a normally de-energized solenoid which normally holds the main pawl 55 in a locking position in which it is engageable with the stop 53. Energization of the electromagnetic means 57 in response to a print command pivots the main pawl 55 clockwise as shown in FIG. 6 to a releasing position in which the flange 137 clears the stop 53 to allow the print disc 13 to roate. In the embodiment illustrated, the anti-backup pawl 61 is in the form of a leaf spring suitably attached to the upper surface of the cover 89 as shown in FIGS. 2, 4 and 6.

The paper 21 and the ribbon 93 can be driven in various different ways. In the embodiment illustrated, the arm 121 (FIG. 5) is suitably drivingly connected to the drive roller 23 (FIG. 2) through a one-way clutch (not shown). Each time the solenoid 29 is energized, the drive roller 23 is driven one increment. The drive roller 23 cooperates with a roller 141 to index the paper 21 over the peripheral surface 17. The one-way clutch which drivingly connects the arm 121 and the drive roller 23 does not transmit the rectrograde movement of the arm 121 on the return stroke of the plunger 30 to the paper 21. Accordingly, the paper 21 is not driven in the reverse direction.

The drive roller 95 (FIGS. 3 and 5) of the ribbon magazine 28 is driven by a suitable drive train 143 (FIG. 5) which in turn is driven by the arm 121. The drive train 143 is shown schematically in FIG. 5 and may take various different forms. The drive train 143 drives the drive roller 95 to advance the ribbon 93 each time the solenoid 29 is energized. The drive train 143 includes a one-way clutch (not shown) or similar device which does not transmit the return motion of the solenoid plunger 30 to the ribbon 93 so that the ribbon 93 is not driven in the reverse direction.

The printer 11 can be incorporated into various devices such as calculators. In use of the calculator one or more buttons of the calculator keyboard will be actuated. If it is desired to print the characters represented by the actuated buttons or if it is desired to perform a calculation, a print button is actuated and the actuation of the print button provides a print command in accordance with known techniques. What is referred to above as a print button can, of course, be any of several different calculator buttons such as the add, substract, or equal buttons.

Assuming that the spring 35 of the printer 11 is cocked and ready for operation, the print command is transmitted to the electromagnetic means 57 to energize the same to pivot the pawl 55 clockwise as viewed in FIG. 6. This moves the flange 137 of the pawl 55 out of the way of the stop 53 to permit clockwise rotation of the print disc 13 under the influence of the spring 35. The electromagnetic means 57 remains energized only momentarily and immediately after the print disc 13 moves the stop 53 past the flange 137 of the pawl 55, the electromagnetic means returns automatically to its deenergized condition thereby returning the main pawl to a position in which it will engage the stop 53 upon the completion of one revolution of the print disc.

The print disc 13 is rotated by the energy stored in the spring 35. The energy is transmitted to the print disc 13 through gear sector 31, the pinion 45, the one-way clutch 47, the gear 49, the print disc pinion 51, and the shaft 15. The timing disc 69 is also directly driven by the shaft 15 through the gear 65 and the timing pinion 67, and this enables the angular position of the print disc 13 to be known at all times. Specifically, the light emitting diode 75 transmits light through one of the slots 73 to the photocell 77 each time one of the slots comes into registry with the diode and the photocell. This occurs each time a character 19 passes a reference location, and accordingly the photocell 77 provides a timing pulse each time a character 19 passes the reference location. These timing pulses can be processed utilizing known techniques so as to operate the hammers 101 at the desired instant to print the sequence of characters called for. Printing is accomplished on the fly, i.e., with the print disc 13 rotating. Printing on the fly is known per se.

Each of the hammers 101 is normally held out of operative engagement with the ribbon 93 as shown in FIG. 2 by the associated spring 109. When one of the hammers 101 is to be operated to print a selected character 19, the associated solenoid 111 is automatically energized to pivot the hammer 101 clockwise as viewed in FIG. 2 to drive the head 103 toward the selected character 19, and this results in printing of the character on the paper 21. This operation is repeated with the necessary hammers 101 to print the complete line of information called for.

On completion of one revolution of the print disc 13, the stop 53 again engages the flange 137 of the main pawl 55 to stop the disc. In this position, counter-rotation of the print disc 13 is prevented by the anti-backup pawl 61 which engages the other side of the stop 53. Thus, the same stop cooperates with the pawls 55 and 61. Because the anti-backup pawl 61 is a resilient leaf spring, it can be readily biased out of the way by the stop 53 to permit the print disc 13 to complete its single revolution. As indicated above, the fly weights 83 cooperate with the drum surface 85 to limit the maximum speed of rotation of the print disc 13.

When the timing pulses from the photocell 77 indicate that the print disc 13 has completed one revolution, the solenoid 29 is automatically momentarily energized. This cocks the spring 35 by imparting movement to the plunger 123 (FIG. 5), the arm 121, the drive member 37, and the sector gear 31 to extend the spring. Energization of the solenoid 29 also indexes the paper 21 and the ribbon 93 in the manner described above. In this manner, the printer 11 is made ready for a second print command whereupon the operation described above is repeated.

As the printer 11 continues to operate, the paper 21 is progressively indexed above the tear bar 26. The guide 25 generally conforms the flexible paper 21 to the curvature of the peripheral surface 17 of the print disc 13. This provides some rigidity to the otherwise flexible paper 21 and causes the paper to rigidly project directly above the tear bar 26 for several inches to allow the operator to readily view the information which has been printed on the paper.

Although an exemplary embodiment of this invention has been shown and described, many changes, modifications and substitutions may be made by those with ordinary skill in the art without necessarily departing from the spirit and scope of this invention.

I claim:

1. A printer for printing characters on a medium in response to a print command, said printer comprising:
- a supporting structure;
- a print member having a peripheral surface;
- means defining a plurality of characters on said peripheral surface;
- means for mounting said print member on said supporting structure for rotation about a rotational axis;
- means for moving the medium over said peripheral surface;
- means on the supporting structure for storing energy;
- transmission means on the supporting structure for drivingly coupling said energy storing means and said print member so that the energy storing means tends to drive the print member in one direction about said rotational axis;
- releasable locking means for holding said print member against rotation in at least said one direction about said rotational axis;
- means responsive to the print command for releasing said releasable locking means to thereby allow the energy storing means to drive the print member;
- means for stopping the rotation of the print member after it has rotated through a predetermined number of degrees whereby the print member does not rotate when it is not being used;
- hammer means cooperable with the characters on the print member after release of said releasable locking means for printing characters on the medium;
- means for restoring energy to the energy storing means;
- said transmission means including a first member coupled to the energy storing means, said first member being movable in a first direction under the influence of said energy storing means to transmit energy from said energy storing means to said transmission means and movable in a second direction to transfer energy from the restoring means to the energy storing means; and
- said transmission means including a one-way clutch which drives when said first member moves in said first direction and which free wheels when said first member moves in said second direction whereby the movement required for restoring energy to the energy storing means is not transmitted to the print member.

2. A printer as defined in claim 1 wherein said predetermined number of degrees is no more than about one revolution.

3. A printer as defined in claim 1 wherein said restoring means automatically restores energy to the energy storing means after the print member has rotated through said predetermined number of degrees.

4. A printer as defined in claim 1 wherein said energy storing means includes a spring.

5. A printer as defined in claim 1 wherein said print member is a print disc.

6. A printer as defined in claim 1 wherein said means for moving the medium moves the medium in a direction which is generally parallel to said rotational axis at least at said peripheral surface of the print member, at least a region of said peripheral surface being curved, said printer including guide means for generally conforming the medium to at least a portion of the curved region of the peripheral surface as the medium is moved over said portion of said curved region whereby the medium is curved generally circumferentially of said rotational axis.

7. A printer as defined in claim 1 wherein said hammer means cooperates with the characters on the print member while the print member is rotating through said predetermined number of degrees to print characters on the medium.

8. A printer as defined in claim 7 wherein said energy storage means rotates the printer member through said predetermined number of degrees without stopping.

9. A printer for printing characters on a medium comprising:
- a supporting structure;
- a print member having a peripheral surface;
- means defining a plurality of characters on said peripheral surface;
- means for mounting said print member on said supporting structure for rotation about a rotational axis;
- a movable member mounted on said supporting structure;
- a spring drivingly coupled to said movable member;
- a solenoid;
- first drive means driven by the solenoid to move said movable member in a first direction to cock said spring thereby storing energy in said spring;
- second drive means drivingly connecting the spring and the print member;
- said second drive means including one-way clutch means free wheeling when said movable member moves in said first direction whereby the motion of said movable member in said first direction to cock said spring is not transmitted to the print member;
- releasable locking means for holding the print member against rotation in at least one direction about said rotational axis;
- means for releasing said releasable locking means to thereby allow the spring to drive the print member;
- means for stopping the rotation of the print member after it is rotated through a predetermined number of degrees; and
- hammer means cooperable with the characters on the print member after release of said releasable locking means for printing characters on the medium.

10. A printer as defined in claim 9 wherein said movable member includes a sector gear mounted for pivotal movement on the supporting structure, said spring being drivingly coupled to the sector gear, said first drive means drivingly connecting the solenoid and the sector gear, and said second drive means includes gear means driven by said sector gear.

11. A printer for printing characters on an elongated flexible medium comprising:
- a supporting structure;
- a print member having a peripheral surface;

means defining a plurality of characters on said peripheral surface;

means for mounting said print member on said supporting structure for rotation about a rotational axis, said peripheral surface at least partially circumscribing said rotational axis;

means for rotating said print member about said rotational axis;

at least a region of said peripheral surface being curved in a direction extending circumferentially of said rotational axis;

means for moving said medium over said peripheral surface in a direction generally parallel to said rotational axis, said medium passing over at least a portion of said curved region;

a curved guide having a slot therein;

means for mounting the guide adjacent the curved region of the print member, said guide being adapted to have the flexible medium pass along one side of the guide and the slot between the guide and the print member, said guide at least assisting to generally conform the flexible medium to the curvature of at least a portion of said curved region;

means for mounting a ribbon for movement along said slot on the other side of the guide, said ribbon being communicable with the flexible medium through said slot;

selectively actuatable hammer means adjacent said slot and cooperable with said medium, said ribbon, said slot and said characters for printing characters on the medium;

said printer being operable in response to a print command and said rotating means being responsive to the print command to rotate the print member through one revolution about the rotational axis;

said hammer means being cooperable with the medium and said characters during said one revolution for effecting said printing on the medium; and said rotating means including a drive mechanism which can be cocked to store energy therein, means for cocking said driving mechanism, means for releasing said drive mechanism to permit the drive mechanism to rotate the print member about said rotational axis, and means for stopping the rotation of the print member after it has rotated through said one revolution.

12. A printer as defined in claim 11 wherein said supporting structure is adapted to support the printer on a horizontal supporting surface and the direction of movement of the medium over said peripheral surface is nonhorizontal and inclined relative to the vertical.

13. A printer as defined in claim 11 wherein said print member includes a print disc having a generally cylindrical periphery, said peripheral surface including said cylindrical periphery of said print disc, said rotational axis being substantially coincident with the central axis of said print disc.

14. A printer as defined in claim 11 wherein said guide includes means defining a tearing edge for use in tearing the medium.

15. A printer as defined in claim 14 wherein said tearing edge is serrated and forms at least a portion of the upper edge of the guide.

16. A printer for printing characters on a medium in response to a print command, said printer comprising:

a supporting structure;

a print member having a peripheral surface;

means defining a plurality of characters on said peripheral surface;

means for mounting said print member on said supporting structure for rotation about a rotational axis;

means on the supporting structure for storing energy;

transmission means on the supporting structure for drivingly coupling said energy storing means and said print member so that the energy storing means tends to drive the print member in one direction about said rotational axis;

releasable locking means for holding said print member against rotation in at least said one direction about said rotational axis;

means responsive to the print command for releasing said releasable locking means to thereby allow the energy storing means to drive the print member;

means for stopping the rotation of the print member after it has rotated through a predetermined number of degrees whereby the print member does not rotate when it is not being used;

hammer means cooperable with the characters on the print member after release of said releasable locking means for printing characters on the medium;

means for restoring energy to the energy storing means by moving at least a portion of the energy storing means in a first direction which tends to drive the transmission means in a manner to counterrotate said print member; and said transmission means including means for substantially preventing the movement of said portion of said energy storing means in said first direction from counter-rotating said print member.

17. A printer for printing characters on a medium in response to each of a plurality of print commands comprising:

a supporting structure;

a print member having a peripheral surface;

means defining a plurality of characters on said peripheral surface;

means for mounting said print member on said supporting structure for rotation about a rotational axis;

means for rotating said print member continuously from an initial position one revolution about said rotational axis in response to each of the print commands back to said initial position;

hammer means cooperable with the characters and the print member during each of said one revolutions of said print member for printing on the fly at least one of the characters on the medium; and said rotating means including an energy storage device, means for transmitting energy from the energy storage device to the print member to rotate the print member in a first direction through said one revolution, and means for restoring energy to the energy storage device without counterrotating the print member.

18. A printer for printing characters on a medium in response to each of a plurality of print commands comprising:

a supporting structure;

a print member having a peripheral surface;

means defining a plurality of characters on said peripheral surface;

means for mounting said print member on said supporting structure for rotation about a rotational axis;

means for rotating said print member continuously from an initial position one revolution about said rotational axis in response to each of the print commands back to said initial position;

hammer means cooperable with the characters and the print member during each of said one revolutions of said print member for printing on the fly at least one of the characters on the medium; and said rotating means including a drive mechanism which can be cocked to store energy therein, means for cocking the drive mechanism, means responsive to the print command to release the drive mechanism to permit the drive mechanism to rotate the print member about said rotational axis, and means for stopping the rotation of the print member after it has rotated through said one revolution.

* * * * *